United States Patent [19]

Bigalke et al.

[11] 4,046,129

[45] Sept. 6, 1977

[54] REGULATING ARRANGEMENT FOR INTERNAL COMBUSTION ENGINES, ESPECIALLY THOSE WITH A FUEL INJECTION SYSTEM

[75] Inventors: Erhard Bigalke; Jürgen Wolf, both of Wolfsburg; Günther Schmelzer, Klein-Schoppenstedt, all of Germany

[73] Assignee: Volkswagenwerk Aktiengesellschaft, Wolfsburg, Germany

[21] Appl. No.: 667,296

[22] Filed: Mar. 16, 1976

Related U.S. Application Data

[63] Continuation of Ser. No. 398,836, Sept. 19, 1973, abandoned, which is a continuation of Ser. No. 116,958, Feb. 19, 1971, abandoned.

[30] Foreign Application Priority Data

Feb. 20, 1970 Germany ..... 2007855

[51] Int. Cl.[2] ..... F02D 1/04

[52] U.S. Cl. ..... 123/32 EA; 123/119 R; 123/140 J; 123/140 MP

[58] Field of Search ..... 123/32 EA, 119 R, 140 MP, 123/140 J, 32 EG, 119 F, 139 E, 179 G, 179 L

[56] References Cited

U.S. PATENT DOCUMENTS

| | | | |
|---|---|---|---|
| 2,943,616 | 7/1960 | Boyer | 123/140 J |
| 3,054,393 | 9/1962 | Schmidt | 123/139 R |
| 3,315,650 | 4/1967 | Bishop | 123/32 R |
| 3,336,912 | 8/1967 | Morris | 123/119 R |
| 3,500,803 | 3/1970 | Long | 123/32 EA |
| 3,554,170 | 1/1971 | Schenk | 123/119 R |
| 3,699,935 | 10/1972 | Adler | 123/139 E |
| 3,705,571 | 12/1972 | Horn | 123/32 EA |
| 3,707,950 | 1/1973 | Schlimme | 123/139 E |

*Primary Examiner*—C. J. Husar
*Assistant Examiner*—Paul Devinsky
*Attorney, Agent, or Firm*—Brumbaugh, Graves, Donohue & Raymond

[57] ABSTRACT

The operation of an internal combustion engine is regulated by an electronic regulation circuit which utilizes suction pipe pressure to modulate the width of a pulsed signal and to vary the amplitude of a sawtooth wave signal in accordance with the duration of said pulsed signal so that the fuel injection to the engine may be controlled as desired under all operating conditions. The regulation circuitry includes apparatus for modifying the slope of the time versus pressure characteristic of the suction pipe transducer to account for the differences between full load and no load torque of the engine. This is accomplished byvarying the amplitude of the sawtooth waveforms by shunting a portion of the charging current to the sawtooth generator in accordance with the load conditions on the engine.

12 Claims, 7 Drawing Figures

INVENTORS,
ERHARD BIGALKE
JURGEN WOLF
GUNTHER SCHMELZER
BY Watson, Cole, Grindle & Watson
ATTORNEYS INVENTORS,
ERHARD BIGALKE
JURGEN WOLF
GUNTHER SCHMELZER
BY Watson, Cole, Grindle & Watson
ATTORNEYS INVENTORS,
ERHARD BIGALKE
JURGEN WOLF
GUNTHER SCHMELZER
BY Watson, Cole, Grindle & Watson
ATTORNEYS

REGULATING ARRANGEMENT FOR INTERNAL COMBUSTION ENGINES, ESPECIALLY THOSE WITH A FUEL INJECTION SYSTEM

This is a continuation of application Ser. No. 398,836 filed Sept. 19, 1973, now abandond which is continuation of application Ser. No. 116,958 filed Feb. 19, 1971, now abandond.

BACKGROUND OF THE INVENTION

The invention relates to apparatus for regulating internal combustion engines, and in particular to a fuel injection system wherein the course of the inner torque, of the engine in dependence on the controlled variable, is defined by a curve (the characteristic torque curve or line) having a maximum and wherein the suction pipe pressure is monitored to provide a means of control of the engine. The invention can also be applied to engines equipped with carburetors insofar as the suction pipe pressure is to be utilized as a means of regulation.

In known electronic regulating apparatus of this type, difficulties arise as a result of regulation of the idling operation, for example in the case of hot starting, or neutral operation after extended coasting in the mountains, or neutral operation following high speed travel, for example, on the expressway. These difficulties may result in the engine stopping.

SUMMARY OF THE INVENTION

As the examinations and considerations made in accordance with the invention have shown, the regulating apparatus can be adapted in the engine at little cost, to the conditions existing for such neutral or idling operation, so that the aforementioned difficulties are avoided. The improvement according to the invention comprises means which will level off, or tend to flatten, the regulating characteristic curve, i.e., the sensitivity of the controlled variable, e.g., fuel injection duration time, to change in the suction pipe pressure in such a way, and leveled to such a degree, that even in the case of disturbance variables occurring during idling operation, the working point of the engine lies on the ascending branch of the characteristic line of the torque characteristic.

It is a primary object of the invention to provide improved electronic fuel injection regulation apparatus that is operative during both unload and full load torque condition of an internal combustion engine. A further object is to provide electronic fuel injection regulating apparatus which has a modified regulation characteristic so that the regulation of fuel injection to an internal combustion engine is obtainable over a wide range of disturbance variables.

BRIEF DESCRIPTION OF THE DRAWINGS

The above objects and features of the invention will be more readily understood with the following description taken with reference to the drawings, wherein.

DESCRIPTION OF A PREFERRED EMBODIMENT

Figure 1:
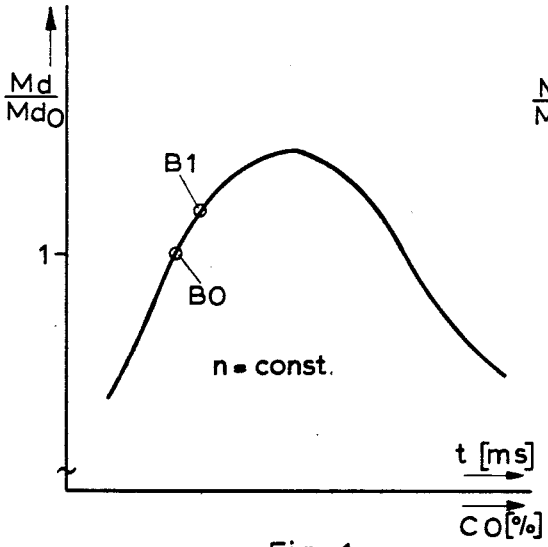
FIG. 1 illustrates the relationship between the ratio Md/Mdo of the inner engine torque Md and inner nominal engine torque Mdo with respect to the controlled variables, time and percentage of carbon monoxide.

The underlying principles of the invention will be understood from the following explanation in connection with FIGS. 1 to 4. In FIG. 1, just as FIGS. 2-4, the assumption has been made that an engine is controlled by an electronic fuel injection and that the duration t of the injection, measured for example in milliseconds, is to be used as the controlled variable. The carbon monoxide content CO, measured in percent in the exhaust gas of the engine, is also related to the duration t of the injection. Therefore, the regulation on which embodiments according to the figures are based operates with enrichment or atrophy of the fuel mixture. However, the invention is not limited to the special use of the duration time of injection as a controlled variable.

In observing the curve according to FIG. 1, which is valid for constant r.p.m.'s of the engine, it is recognized that with an increased duration time t of injection a region of an increasing inner torque occurs until, after a maximum has been reached, the torque decreases. The customary operating point of the engine has been designated as BO.

It will be understood by those skilled in the art that the terms "inner engine torque" or "inner torque" as used herein designate the torque developed by the engine as a consequence of the combustion of fuel within the cylinders apart from any conversion of the torque by means or devices, such as gears and the like, external to the engine proper. The "inner norminal engine torque" is then the inner torque of the engine at the rated, or "nominal", engine idling speed.

Figure 2:
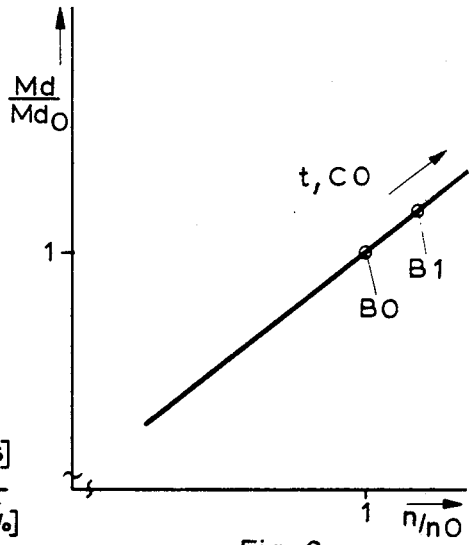
FIG. 2 shows the relationship between the ratio Md/Mdo of the inner engine torque Md and the inner engine nominal torque Mdo with respect to the ratio n/no of the engine r.p.m.,*n*, to the nominal idling r.p.m., no.

In FIG. 2 the characteristic curve formed by the ratio of the inner torque Md of the engine to the nominal torque $Md_o$ has also been plotted as function of engine r.p.m. and more specifically to the ratio of engine r.p.m.,*n*, to the nominal idling r.p.m.,$n_o$. The operating point BO of the engine is shifted to B1 with increasing duration time t of the injection or with an increasing carbon monoxide content CO in the exhaust gases in the direction of higher values of both the engine r.p.m. and the inner torque.

Figure 3:
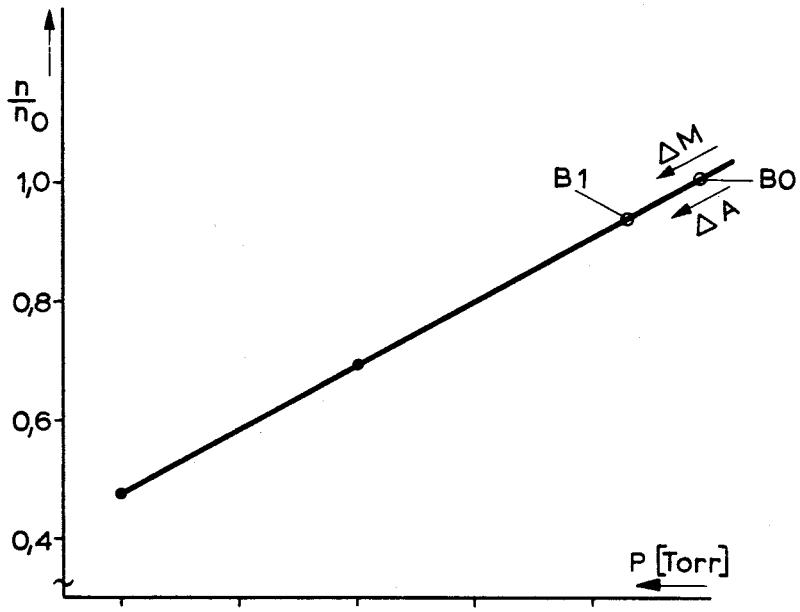
FIG. 3 illustrates the relationship between the ratio n/no of the engine r.p.m.,n, and the nominal idling r.p.m., no, with respect to suction pressure, P.

As explained above, the suction pressure P of the engine, or a value derived from it, is to be used as the monitored or sensed variable. Correspondingly, FIG. 3 gives the relationship between engine r.p.m.,*n*, related again to the idling nominal engine r.p.m.,$n_o$, and the suction pipe pressure P, measured for example in terrestrial atmospheres. It should be noted that the suction pipe pressure has been plotted to decrease in a positive direction of the abscissa, and therefore the engine r.p.m. decrease with an increasing suction pressure according to the curve of FIG. 3. These relationships, as recognized in accordance with the invention, are valid only in the case of idling.

Figure 4:
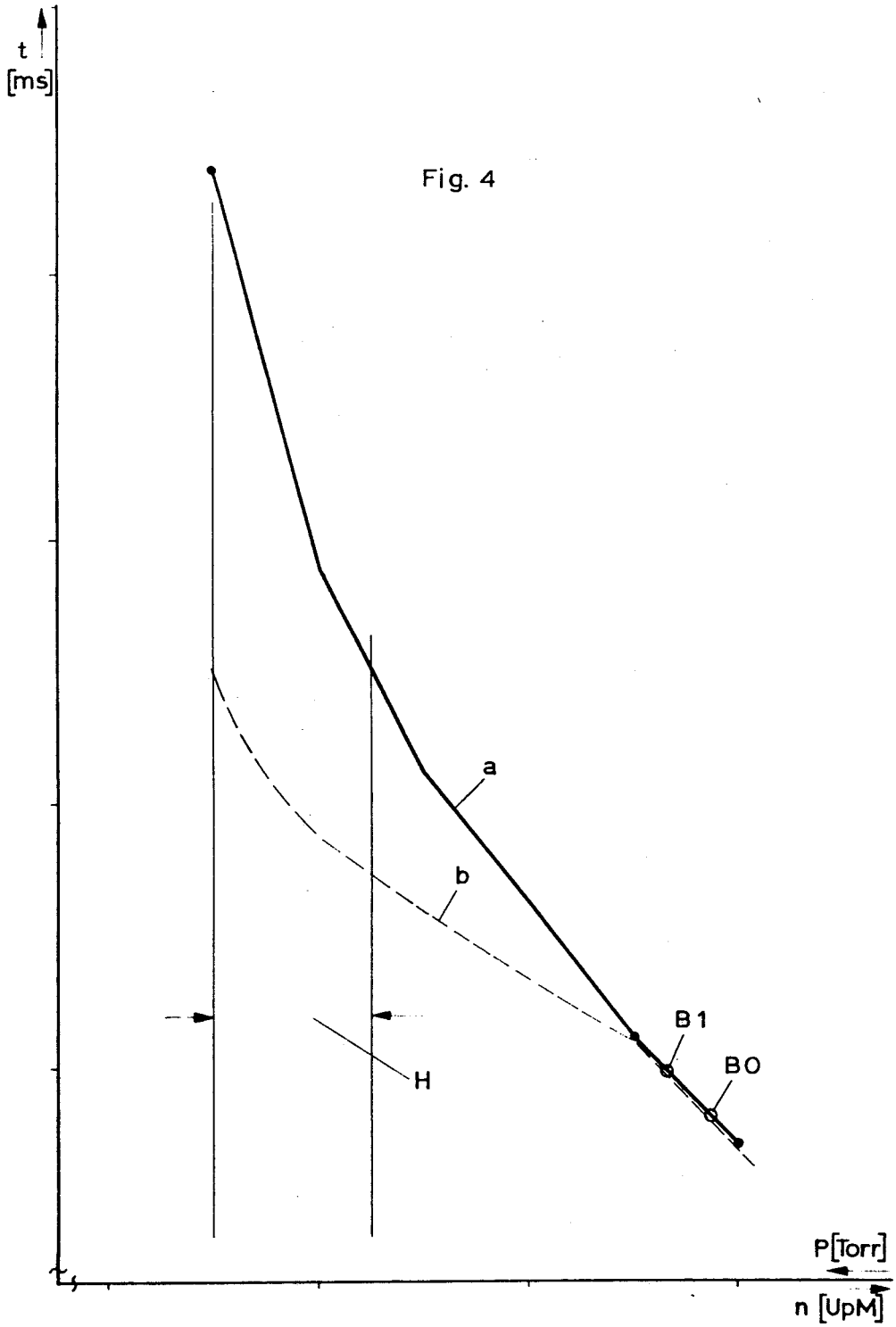
FIG. 4 shows a characteristic curve of time, t, of injection with respect to both suction pressure, P, and r.p.m.,*n*.

Finally, FIG. 4 represents the relationship between the controlled variable, in this case duration time t of the injection, and the suction pipe pressure P. The abscissa can also be designated as engine r.p.m.,*n*, measured in revolutions per minute, corresponding to the relationship represented in FIG. 3.

The curves represented in FIGS. 1 to 4 relate to an automobile engine with electronic regulation of the injection of gasoline, however, such relationships may also be valid for other types of engine, and the invention can also be applied to such engines.

Now the injection regulation apparatus serves to keep the engine r.p.m. constant, independent of any occurring disturbance variables. Such disturbance variables may be, for example, a change of the load or load moment, ΔM, of the engine or a decline in the air, and thus in the fuel-air mixture, delivered to the cylinders because of heating up of the suction pipe. The last-mentioned disturbance variable may be considered as a reduction Δ A of the cross section in the suction channel. The result of both disturbance variables is that the engine r.p.m.,*n*, drops and the absolute pressure P of the suction pipe rises. In FIG. 3 the assumption is made that the disturbance variable which occurs is followed by a shifting of the operating point BO of the engine to operating point B1 insofar as no regulation is available. This shifting of the operating point from BO to B1 causes, in accordance with the regulating characteristic of FIG. 4, the controlled variable (the duration time t of injection) to increase. This increase, according to FIG. 1 and assuming a constant engine r.p.m., causes an increase of the inner engine torque Md by shifting--but in this case through the injection regulation--of the operating point also from BO to B1. This increase in the inner torque Md caused by the injection regulation is related in turn (and according to FIG. 2) to an increase in the engine r.p.m.,*n*, so that it will also result in a shift of the operating point from BO to B1 in FIG. 2.

As can easily be seen from FIG. 4, the sensitivity of the injection regulation is represented by the steepness of the regulating characteristic line. The latter characteristic is determined by the transfer characteristic of the pressure sensor for the determination of the suction pipe pressure, which is coordinated with the requirement made of the control in the case of partial and full load operation, the engine r.p.m. function of the apparatus and the engine r.p.m. characteristics as indicated in FIG. 3.

The above explanations presuppose the occurrence of such small disturbance variables that the operating point of the engine in the diagram according to FIG. 1 is never shifted as a result of operation beyond the maximum of the curve shown there. But this will be the case with a regulating characteristic line of the customary type as indicated by curve a in FIG. 4, particularly since the relative change of the duration time t of the injection becomes longer, the greater the drop in the engine r.p.m.

A shifting of the operating point of the engine into the declining right-hand range of the curve in FIG. 1 may, however, also occur, for example, whenever, as in the case of starting a hot engine, the idling r.p.m. lies considerably below the rated r.p.m. In the regulating characteristic line according to FIG. 4, the hot start region has been indicated as H. One can recognize that here there are already relatively long injection times t, so that the case of a further drop in the r.p.m.,*n*, there is a possibility that the injection time t will be extended beyond the value assigned to the maximum of the curve in FIG. 1. In this area particularly, the regulating characteristic line a is very steep so that any regulation of the controlled variables will not bring about an increase of the inner torque Md of the engine. To the contrary, an even continuing decrease of inner torque corresponding to the right branch of the curve in FIG. 1, will occur and finally the motor stops because of too rich a gasoline mixture.

Now according to the invention, these difficulties are avoided because the regulating characteristic line (see FIG. 4) is modified to have a decreased slope as indicated by curve b. The regulating characteristic line has been flattened in a region of the monitored quantity, in this case of the suction pipe pressure P, to such a degree that even in the case where disturbance variables occur in the idling operation, the operating point of the engine will lie on the ascending branch of the characteristic line for the torque (FIG. 1).

Obviously, it will not be possible to eliminate the effects of very large disturbing factors occuring during the regulation of the idling operation, but all normally occurring disturbance variables can be taken into consideration and regulated.

Although the aforesaid modification of the regulating characteristic does not take care of large disturbances occurring during engine idling, means may be provided which become effective especially during idling operation and which will then provide the necessary flattening of the regulation characteristic. Further, the apparatus must also have a regulation character coordinated for partial and full loads which, therefore and in a manner already described, depends upon the suction pipe pressure and the characteristic of the pressure sensor, which characteristic must also not be too flat. This can be achieved, at least in part, by initiating the flattening of the regulation characteristic at the values of the suction pipe pressure which are lower pressures in the region of a hot engine start.

In the case of the preferred embodiment of the invention, means are used to provide a flattened regulation characteristic. The injection time is determined electronically by the amplitude values of electronic sawtooth signals dependent on the sensed value of the monitored variable. The flattening of the regulation characteristic is obtained by flattening the sawtooth waveform by shunting the charging circuit of a capacitor by means of a threshold sensitive component which is activated only in the case of idle operation of the engine with a corresponding positioning of the throttle valve switch. A diode is used as the threshold sensitive circuit element value and the throttle valve switch itself establishes selected potential connections in such a manner that the diode becomes effective only during no load operation. The consequence of this is that in partial and full load operation, the characteristic line a in FIG. 4 is effective while in the case of no load operation a conversion to the flattened characteristic b is obtained.

Figure 5:
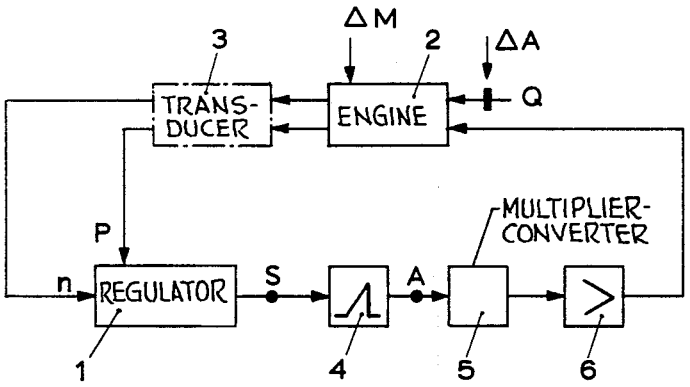
PRIOR ART Fig. 5
FIG. 5 is a block diagram of a known regulating circuit for partial and full engine load operation.
Figure 6:
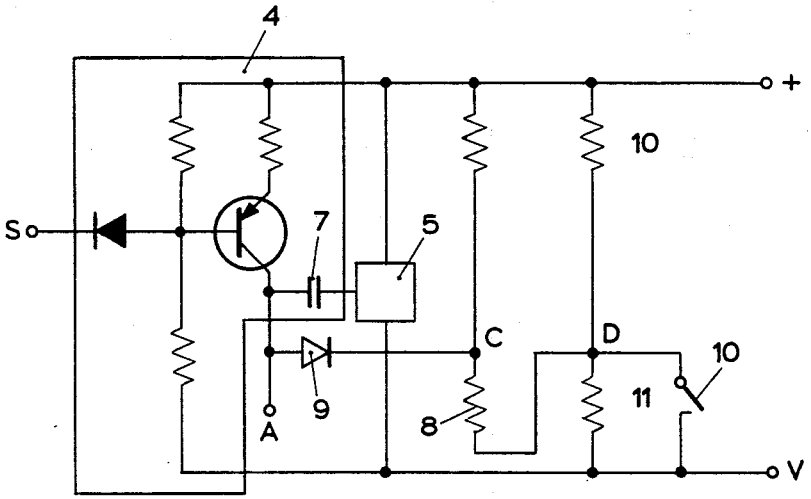
FIG. 6 is an embodiment of the regulating apparatus according to the invention.
Figure 7:
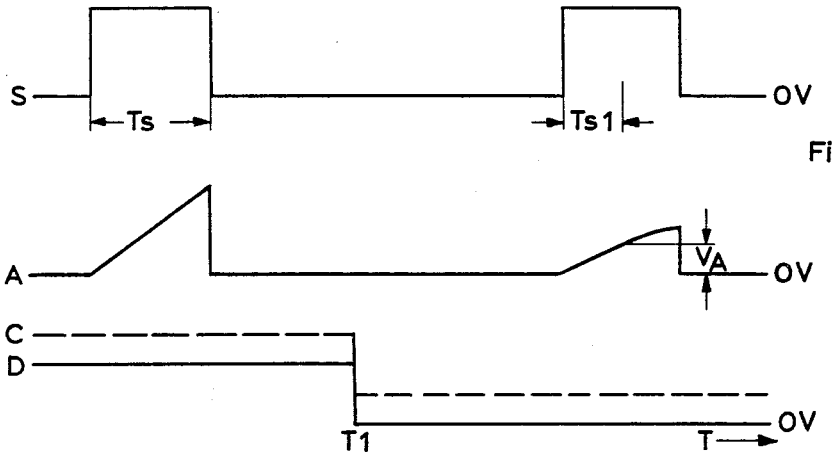
FIG. 7 illustrates typical waveforms of the signals in the apparatus of FIG. 6.

The preferred embodiment for ignition regulating apparatus will be understood from the following explanation with the aid of FIGS. 5, 6 and the waveforms illustrated in FIG. 7. FIG. 5 represents known regulating circuitry for obtaining full and partial load operation, which comprises electronic regulator 1, regulated engine 2, transducer 3, for obtaining suction pipe pressure P and the r.p.m. of the engine as well as other data which may be necessary in accordance with the special design of the regulating apparatus. Continuing with FIG. 5, sawtooth generator 4 produces sawtooth signals in a known manner by charging a capacitor, the amplitude of these signals being dependent on the artificial output of the regulator. Multiplier-converter stage 5 is of known construction and converts the sawtooth signal amplitude into pulses of corresponding duration. Output circuit 6 provides the proper injection time corresponding to the required regulation as indicated by the output from multiplier-converter 5.

Δ M represents changes in the load moment of the engine and changes of the temperature in the suction pipe are indicated as changes Δ A of the cross section of the suction pipe from the nominal value Q of the cross section. Variables other than those indicated in FIG. 5 may be fed to regulator 1, such as for example an indication of the engine temperature.

The known regulation circuitry of FIG. 5 is modified according to the circuitry illustrated in FIG. 6. Sawtooth generator 4 is formed by a monostable trigger stage comprising a transistor, whose inlet terminal is indicated by S and whose output terminal for tapping the sawtooth signals has been designated by A. Rectangular voltage pulses are fed to the sawtooth generator 4 through input terminal S, which pulses according to FIG. 7 have a duration Ts which depends on the pertinent suction pipe pressure P. These pulses are converted to sawtooth pulses by means of the capacitor 7 in the sawtooth generator 4, the amplitude of which likewise increases with increasing duration Ts as shown in FIG. 7. Without the measures according to the invention for obtaining a modified or flattened region of the regulating characteristic, designated in FIG. 4 by *b*, sawtooth pulses would result, which in regard to their amplitude, have practically been dictated by the characteristic of the pressure transducer determining the suction pipe pressure, which is equivalent to the characteristic *a* of FIG. 4.

In order to take the special conditions during no-load operation into account, a circuit is connected to point A which includes resistance 8, threshold sensitive element 9, a diode, as well as contact 10 of the throttle valve switch. If contact 10 is closed during the no-load operation, and if the voltage on capacitor 7, that is to say at terminal A, has risen to a value VA (see FIG. 7), which is greater than the voltage V (see FIG. 6), whereby consideration is made for the threshold voltage of diode 9, the diode is forward biased and begins to conduct, which flattens the voltage charge on capacitor 7 as indicated in FIG. 7. This amplitude limitation of the sawtooth signals has the same effect as a decrease in the duration of the rectangular impulses of Ts to TS1, which impulses exist at the terminal S.

As the last waveform of FIG. 7 shows, in which the potentials at points C and D of the circuit in FIG. 6 are indicated, the closing of the contact 10 in the circuit time TSI decreases the potential at the switching point D to the value of the potential V, in this example to 0 volts; otherwise, point D lies on the potential given by the voltage distribution ratio of resistances 11 and 12, which potential, however, is too high for diode 9 to become conductive.

What is claimed is:

1. In a device for regulating an internal combustion engine in which the variation of engine torque with respect to a controlled variable of the engine defines an engine torque curve which rises to a maximum and then decreases therefrom, including means operative under partial and full engine load operation for regulating the controlled variable in response to change in the suction pipe pressure of the engine and in accordance with a predetermined regulating relationship defining a first characteristic line, the improvement comprising means, operative during engine idling operation only, for modifying said first characteristic line into a second characteristic line at least a portion of which is of lesser slope than said first characteristic line, said second characteristic line having at least a point in common with said first characteristic line and having a porton which exhibits lower values than said first characteristic line such that the values of the controlled variable produced by the regulating means in response to operational disturbance variables during idling always lie in the rising portion of said engine torque curve.

2. A device according to claim 1 wherein the modifying means is operative to initiate reduction in the rate of change of the controlled variable at suction pipe pressures lower than pressures occurring in a hot suction pipe.

3. A device according to claim 1 wherein the modifying means includes throttle valve switch means for placing the modifying means in an operative condition upon movement of the throttle valve to the idling position.

4. A device according to claim 1 wherein the controlled variable is the time duration of fuel injection.

5. A device according to claim 4 wherein the regulating means includes means responsive to the suction pipe pressure for producing output signals of a duration representative of the suction pipe pressure, means responsive to the output signals for providing a repetitive pulsed signal having an amplitude representative of the duration of the output signals, and means responsive to the pulsed signal for varying the fuel injection time duration in correspondence with the amplitude of the pulsed signal; and wherein the modifying means comprises means effective only during engine idling operation for limiting the amplitude of the pulsed signal, thereby to limit the duration of the injection time.

6. In a device for regulating a fuel injection engine in which the variation of engine torque increasing time of injection defines a curve which rises to a maximum then decreases therefrom, including means operative under partial and full engine load operation for regulating the fuel injection duration time in response to change in the suction pipe pressure of the engine in accordance with a predetermined relationship, said regulating means including means responsive to the suction pipe pressure for producing output signals of a duration representative of the suction pipe pressure, a sawtooth signal generator responsive to the output signals for providing repetitive sawtooth signals and including electrical capacitative means for relating the amplitudes of the sawtooth signals to the duration of the output signals from the suction pressure responsive means, and means responsive to the sawtooth signals for varying the injection time duration in correspondence with the amplitude of the sawtooth signals, the improvement comprising:

electric current shunting means for limiting the voltage stored by the capacitative means, thereby to limit the amplitude of the sawtooth signals, such that, in response to changes in suction pipe pressure resulting from the occurrence of operational disturbance variables during idling, the regulating device tends to maintain the fuel injection duration time at a value les than that time which would otherwise be produced by the regulating means in response to suction pipe pressure as the engine torque falls beyond the maximum torque value of said curve, and throttle valve switch means for energizing the current shunting means when the throttle valve is in the idling position and for deenergizing the current shunting means when the throttle valve is at an engine load position.

7. A device according to claim 6 wherein the current shunting means comprises a diode coupled to the sawtooth generator in parallel with the capacitative means, a voltage source for applying a biasing voltage to the diode upon movement of the throttle valve switch to the idling position to bias the diode against conduction, and a resistance coupled between the diode and the throttle valve switch, whereby the diode is rendered conductive upon increase of the voltage stored by the capacitative means above the value of the biasing voltage applied to the diode to shunt charging current from the capacitative means, thereby limiting the charge acquired by the capacitative means and thus the duration of the injection time.

8. A method for regulating the operation of an internal combustion engine in which the variation of engine torque with respect to a controlled variable of the engine defines an engine torque curve which rises to a maximum and then decreases therefro, comprising, during partial and full engine load operation, regulating the controlled variable in response to change in suction pipe pressure of the engine and in accordance with a predetermined regulating relationship defining a first characteristic line and, during engine idling operation only, modifying said first characteristic line at into a second characteristic line at least a portion of which is of less slope than said first characteristic line, said second characteristic line having at least a point in common with said first characteristic line and having a portion which exhibits lower values than said first characteristic line such that the values of the controlled variable produced by regulation in response to operational disturbance variables during idling always lie in the rising portion of said engine torque curve.

9. A method according to claim 8 wherein modifying the predetermined relationship is initiated to reduce the rate of change of the controlled variable at suction pipe pressures lower than pressures occurring in a hot suction pipe.

10. A method according to claim 8 wherein modifying the predetermined relationship is initiated upon movement of the engine throttle valve to the idling position.

11. A method according to claim 8 wherein the controlled variable is the time duration of fuel injection.

12. A method according to claim 11 wherein regulating the controlled variable includes producing output signals of a duration representative of suction pipe pressure, providing a repretitive pulsed signal having an amplitude representative of the duration of the output signals, and varying the injection time duration in correspondence with the amplitude of the pulsed signal; and wherein modifying the predetermined relationship includes limiting the amplitude of the pulsed signal, thereby to limit the duration of the injection time.

* * * * *